US005215276A

United States Patent [19]

Aoki et al.

[11] Patent Number: 5,215,276

[45] Date of Patent: Jun. 1, 1993

[54] REMAINING PAPER REWINDING DEVICE IN A PRINTING SYSTEM

[75] Inventors: Katsumi Aoki, Yokosuka; Toshio Kansaku, Sagamihara, both of Japan

[73] Assignee: Kabushikigaisha Tokyo Kikai Seisakusho, Tokyo, Japan

[21] Appl. No.: 808,655

[22] Filed: Dec. 17, 1991

[30] Foreign Application Priority Data

Dec. 21, 1990 [JP] Japan ..... 2-413462

[51] Int. Cl.[5] ..... B65H 19/10

[52] U.S. Cl. ..... 242/64; 242/58.1

[58] Field of Search ..... 101/228; 242/56 A, 64, 242/58.1, 58.3

[56] References Cited

U.S. PATENT DOCUMENTS

| | | | |
|---|---|---|---|
| 3,093,336 | 6/1963 | Caulfield et al. | 242/56 A |
| 3,374,963 | 3/1968 | Conti | 242/64 |
| 3,480,223 | 11/1969 | Porter | 242/64 |
| 3,635,415 | 1/1972 | Phelps et al. | 242/64 |
| 3,784,122 | 1/1974 | Kataoka | 242/56 A |
| 3,794,256 | 2/1974 | Schwarz | 242/56 A |
| 4,129,265 | 12/1978 | Bandy, Jr. | 242/56 A |
| 4,265,409 | 5/1981 | Cox et al. | 242/56 A |
| 4,516,742 | 5/1985 | Townsend | 242/64 |
| 4,564,149 | 1/1986 | Barzanó | 242/58.1 |
| 4,612,080 | 9/1986 | Aiuola et al. | 242/58.3 |
| 4,903,909 | 2/1990 | Suziki | 242/58.3 |

FOREIGN PATENT DOCUMENTS

| | | |
|---|---|---|
| 58-114249 | 8/1983 | Japan . |
| 62-15454 | 4/1987 | Japan . |
| 63-71054 | 3/1988 | Japan . |
| 64-32855 | 3/1989 | Japan . |

*Primary Examiner*—Edgar S. Burr
*Assistant Examiner*—Lynn D. Hendrickson
*Attorney, Agent, or Firm*—Foley & Lardner

[57] ABSTRACT

This invention relates to a remaining paper rewinding device for a paper feeding apparatus in a printing system. This device has a simple structure with a compact size, which can be easily assembled and whose maintenance can be easily carried out.

The remaining paper rewinding device comprises a rotary shaft rotatively driven, a pair of Y-form paper roll support members which are oppositely arranged on the rotary shaft, a plurality of paper roll support stems each of which is pivotally arranged on the same circumference of the paper roll support member and in parallel to the rotary shaft so that the opposite support stems are aligned with each other, a plurality of drive units each of which is assembled on the paper roll support stem arranged on at least one side of the paper roll support members, and a drive power transmission unit which can be selectively engaged with the drive unit to transmit the rotating drive force from a power unit to the engaged drive unit.

7 Claims, 5 Drawing Sheets

REMAINING PAPER REWINDING DEVICE IN A PRINTING SYSTEM

BACKGROUND OF THE INVENTION

1. Field of the Invention

The present invention generally relates to a remaining paper rewinding device in a paper feeding mechanism of a printing system. In particular, the present invention relates to a remaining paper rewinding device which is adapted for a paper feeding mechanism in a rotary press printing system equipped with a plurality of rolls of printing paper.

2. Detailed Description of Prior Art

Conventionally, remaining paper rewinding or winding up devices incorporated in a paper feeding mechanism have been disclosed in various documents such as Japanese Patent Application for Utility Model Laid-Open Publication No. 58-114249, entitled "Recovery Device for Used Spool of Paper Roll in Rotary Press Printing Apparatus" (referred to as "prior art 1"), Japanese Patent Publication No. 62-15454, entitled "Paper Feeding System equipped with Automatic Remaining Paper Winding-Up Device" (referred to as "prior art 2"), Japanese Patent Application Laid-Open Publication No. 63-71054, entitled "Rolled Paper Feeding Device" (referred to as "prior art 3", and Japanese Patent Application for Utility Model Laid-Open Publication No. 64-32855, entitled "Recovery Device of Fed Paper in Paper Feeding Apparatus" (referred to as "prior art 4").

In the prior art 1, the recovery device recovers a used spool after the connection between the rolled paper wound on the used spool and a new one. This device comprises a rewinding mechanism for rotating the used spool which is arranged at the upper surface of a remaining paper support section and which is movably supported in the vertical direction. To recover the used spool, a rewinding roller of the rewinding mechanism is brought into contact with the circumferential surface of the used spool and is supported by a paper roll support arm which is shifted in a used spool recovery position, or by a roller at the end of a chucking device for supporting the used spool, and the rewinding roller is then driven by a drive motor.

In the prior art 2, the paper feeding system includes plural drive motors for controlling the tension of a paper web fed by this system and for driving a shaft of a paper roll spool, as a predrive means. The motor(s) is reversely driven for a predetermined period of time or for a predetermined number of rotations after a cutter of an automatic paper web connecting device is actuated so that the remaining paper is wound up by the spool.

In the prior art 3, the rolled paper feeding device includes a drive motor assembled on a support member of a rolled paper to always engage with a support shaft of the rolled paper through gears and a brake mechanism so that the remaining paper of a used rolled paper, after the connection between the preceding rolled paper and the succeeding rolled paper, is rewound to the spool of the used rolled paper.

In the prior art 4, the recovery device for the paper feeding apparatus includes an arm which is provided at its end with a drive power transmitting member, an arm swinging means and a rotational drive means for rotatingly driving the drive power transmitting member. A support member for paper rolls is assembled on a rotary shaft, is provided with a plurality of paper roll support members each of which pivotally supports one paper roll. When the preceding paper roll support member supporting the used paper reaches a predetermined position after the paper connecting operation, the arm swing means is actuated to make the drive power transmitting member engage with the support member of the used paper roll so that the rotational drive means rewinds the remaining paper of the paper roll.

However, these conventional devices cause the following problems. The device of prior art 1 tends to be large-sized and complicated because the support member for the used spool is provided with the rewinding roller and the additional motor. In the case where the width of the paper roller is not constant, some troubles may occur. For example, when the newspaper rolls No. A to E defined by JIS P3000; the width of the A roll is about three times greater than that of the E roll. The used spool support member must be adapted for the A roll and the rewinding roller must be adapted for the E roll at the same time. In other words, it is difficult to act both the spool support member and the rewinding roller effectively for the whole width of the paper rolls.

The devices shown in prior art 2 and 3 each require the drive motor and the reverse driving means of the driving power from it for each spool shaft, thereby increasing the cost of these devices.

The device shown prior art 4 performs the remaining paper rewinding operation by two operation stages of the arm swing means and the rotational drive means. Therefore, the operational timing of these means must be adjusted, and further the arm swing means requires additional piping and wiring works so that of this device will be complicated and the corresponding maintenance of this device will be troublesome for the operator.

SUMMARY OF THE INVENTION

It is therefore an object of the present invention to provide a remaining paper rewinding device which has a simple mechanism produced at a low cost and that can be easily operated without any troubles.

Another object of the present invention is to provide a remaining paper rewinding device which facilitates continuous paper feeding operation in a printing apparatus with a smooth paper connection between the preceding paper roll and the succeeding paper roll.

To accomplish the above described object, the remaining paper rewinding device according to the present invention comprises a rotary shaft rotatively driven, a pair of Y-form paper roll support members which are oppositely arranged on the rotary shaft, a plurality of paper roll support stems each of which is pivotally arranged on the same circumference of the Y-form paper roll support member and in parallel to the rotary shaft so that the opposite support stems are aligned with each other, a plurality of gears each of which is assembled on one end of the support stem, and a drive power transmission unit which can be selectively engaged with the gear to transmit the rotating drive force from a power unit to the engaged gear.

Other features and advantages of the invention will be apparent from the following description taken in connection with the accompanying drawings.

DETAILED DESCRIPTION OF THE PREFERRED EMBODIMENT

One preferred embodiment of the present invention is described in conjunction with the accompanying drawings.

Figure 1:
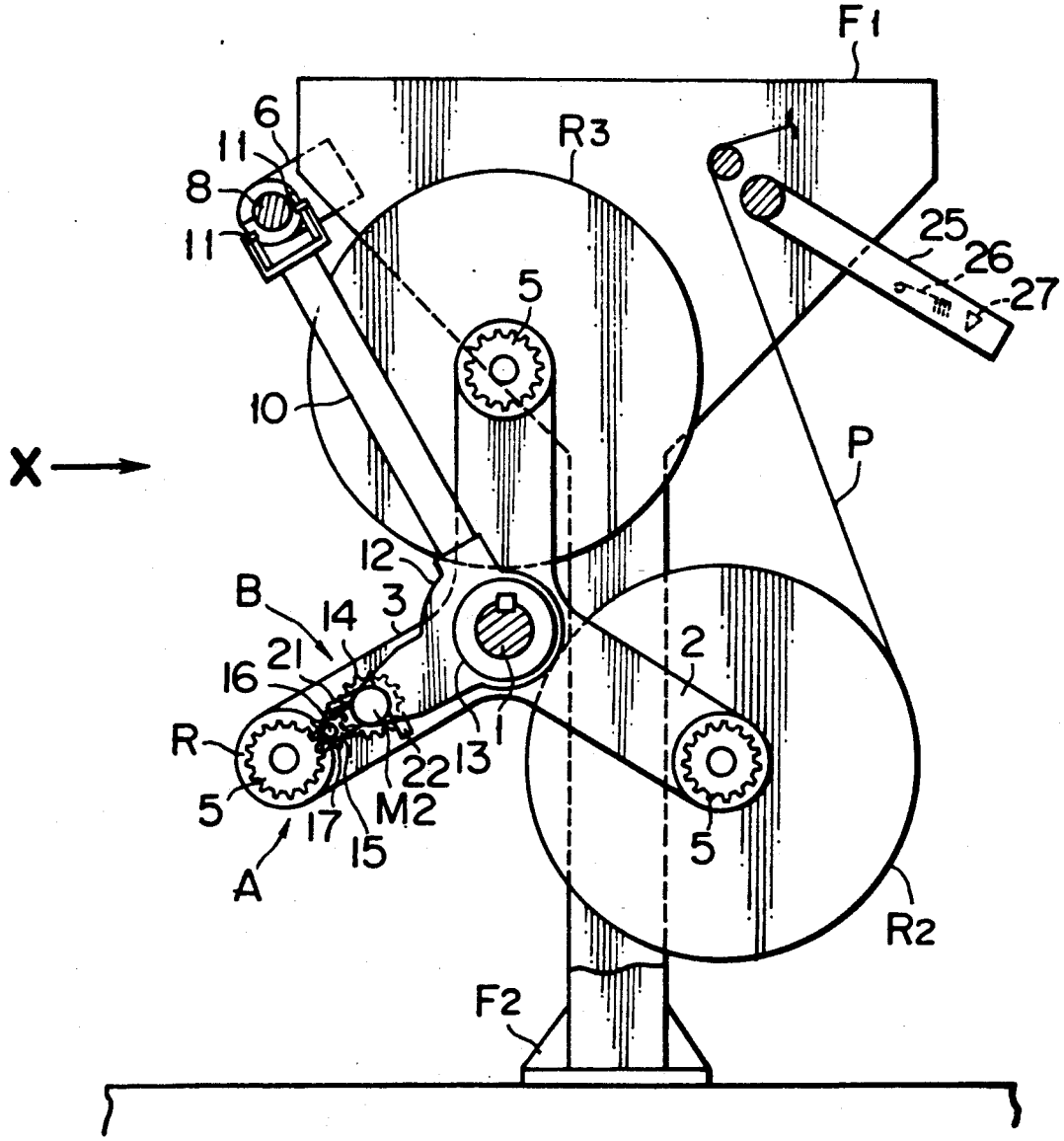
FIG. 1 is a schematical elevation partly in section showing a paper feeding device equipped with the remaining paper rewinding mechanism according to the present invention.
Figure 2:
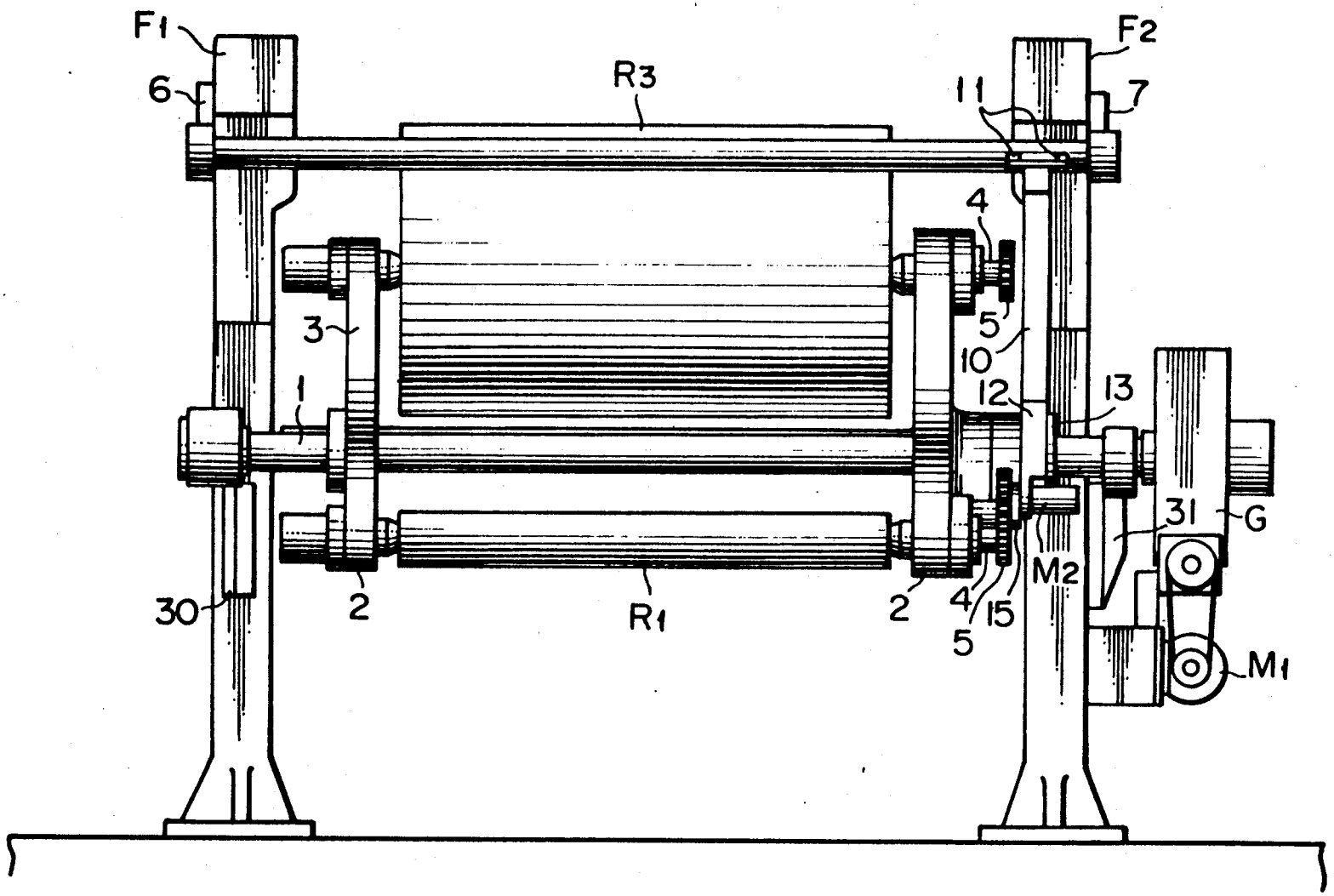
FIG. 2 is a schematic illustration taken in the direction of arrow X of the paper feeding device shown in FIG. 1.

Referring to FIG. 1 and FIG. 2, a paper feeding device is provided with a paper roll support means A for supporting three paper rolls R1, R2 and R3. The paper roll support means A includes a rotary shaft 1 and a pair of paper roll support members 2, 2. The rotary shaft 1 is rotatably supported by brackets 30, 31 which are respectively fixed on frames F1, F2 which are oppositely arranged. The rotary shaft 1 is rotated by a first motor M1 mounted on the frame F2 through a gear box G. The paper roll support members 2, 2 formed in an essentially Y-form whose three arms 3, 3, 3 radially extend at a center angle of 120° are slidably mounted on the rotary shaft 1 at opposite ends from each other.

At the top end of each of the three arms 3, 3, 3 a paper roll support stem 4 is rotatably assembled. Two support stems 4, 4 oppositely arranged are aligned in the same axis which is parallel to the axis of the rotary shaft 1 so that the paper rolls R1, R2, R3 are respectively set in the spaces defined between two support stems 4, 4. Each of the support stems 4, 4, 4 arranged at one of the Y-form support members 2 is provided with a gear 5 to transmit a rotational movement to the stem 4. One of the gears 5, 5, 5 is selectively engaged with a drive power transmission unit B assembled on at an arm end of a sleeve 12.

Figure 3:
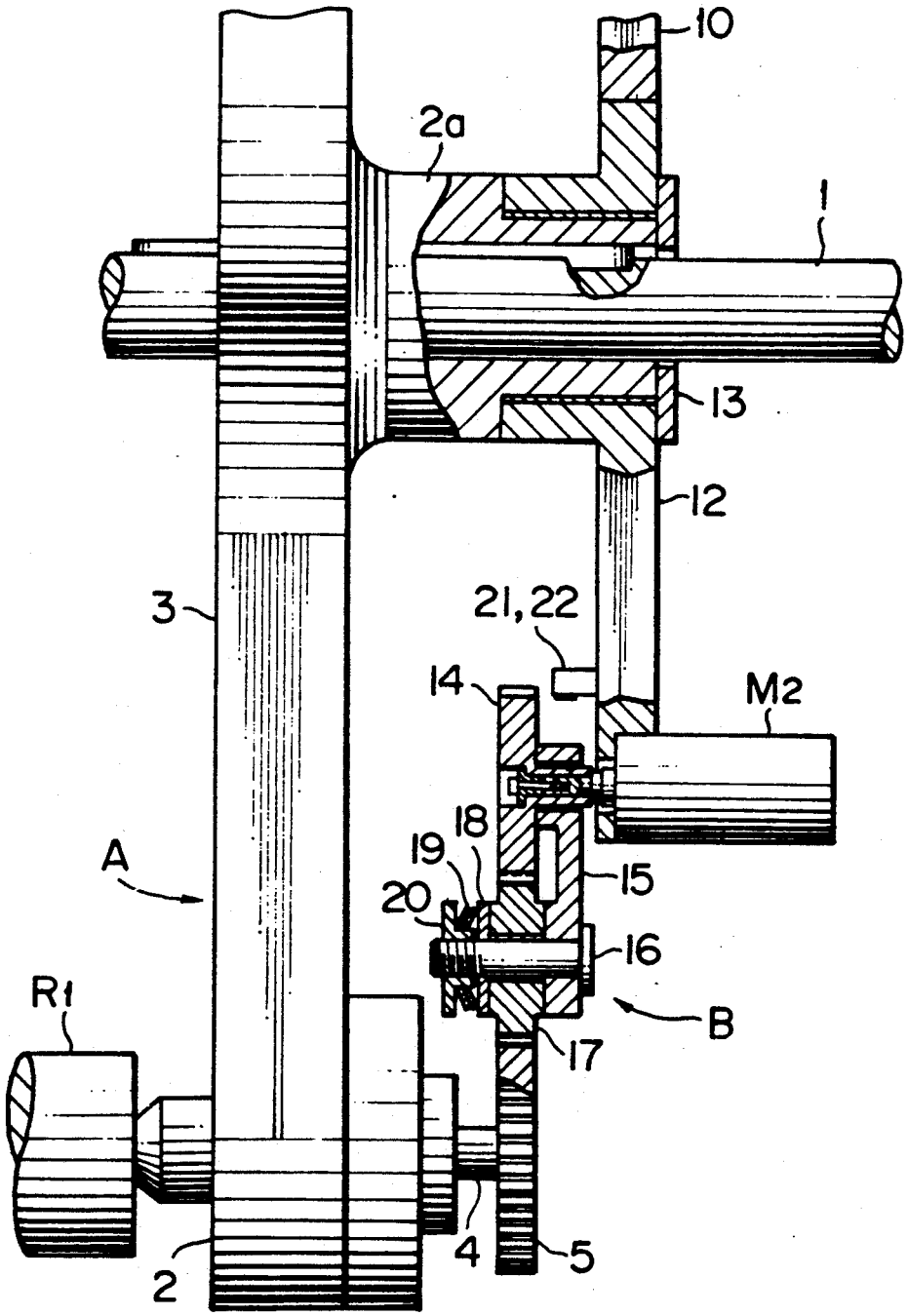
FIG. 3 is a partially sectional view showing essential members of the device shown in FIG. 2.

The drive power transmission unit B is shown in FIG. 3, wherein a second motor M2 is fixed on one end of the arm of the sleeve 12. A gear 14 is fixedly assembled on a drive shaft of the second motor M2. The gear 14 is further connected to an arm 15 in such a manner that the base section of the arm 15 is rotatably mounted on the base of the gear 14. The arm 15 is formed with an opening in the arm end, through which opening a shaft 16 is fixedly set in parallel to the drive shaft of the second motor M2. One end of the shaft 16 is formed with a male screw. On the shaft 16, a gear 17 is meshingly engaged with the gear 14, and a friction plate 18, and a dish-shape spring 19 are also mounted. The male screw of the shaft 16 is threadingly engaged with a female screw section formed in a spring shoe 20 so as to retain the gear 17 between the spring shoe 20 and the arm 15 through the friction plate 18 and the dish-shape spring 19. The friction plate 18 is always urged toward the gear 17 due to the biasing force of the dish-shape spring 19. This biasing force can be adjusted by moving the spring shoe 20, and the adjusted position can be also locked by any suitable lock member, not shown.

The sleeve 12 is provided with two stoppers 21 and 22 to restrict the swing motion of the arm 15. Further the sleeve 12 is rotatably mounted on the base section 2*a* of the Y-form support member 2. The sleeve 12 is retained by a ring 13 mounted on the rotary shaft 1 and fixed on the end surface of the base section 2*a* so that the sleeve 12 is prevented from slipping out of the base section 2*a* of the Y-form support member 2 or moving in the axial direction of the shaft 1.

The sleeve 12 is further connected to one end of a rod 10 whose other end is connected to a guide bar 8 the ends of which are fixed on brackets 6 and 7 which are respectively fixed on the frames F1 and F2. Thus the guide bar 8 is arranged in parallel to the rotary shaft 1. According to this arrangement, the turning motion of the sleeve 12 about the rotary shaft 1 is restricted.

In the embodiment shown in FIG. 1 and FIG. 2, the rod 10 is movably connected to the guide bar 8 through small rollers 11 (four rollers in this embodiment) to make the drive power transmission unit B follow the Y-form support member 2 when it is moved in the axial direction of the rotary shaft 1.

Figure 4:
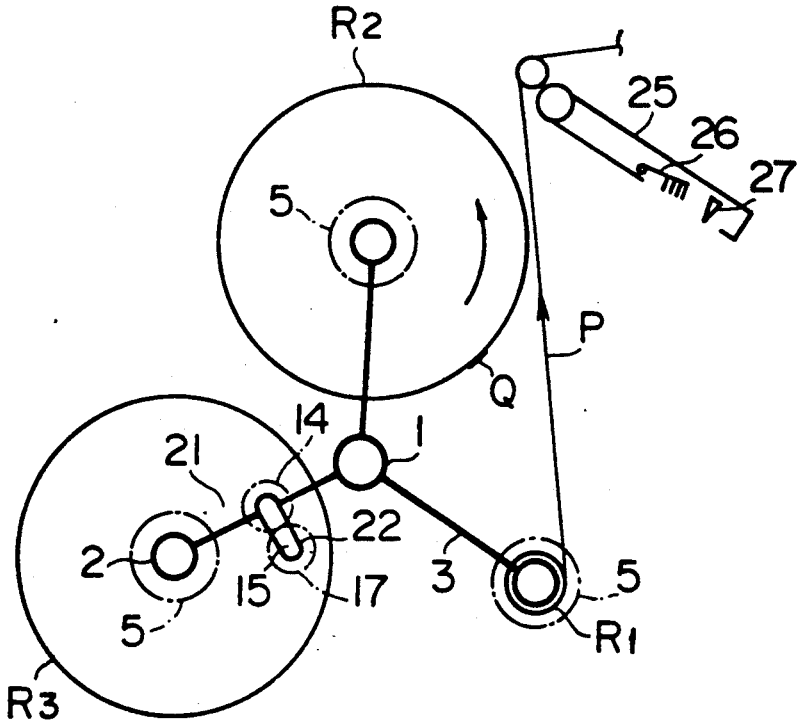
FIG. 4 to FIG. 7 are schematic illustrations explaining the operating states of the paper feeding equipped with the remaining paper rewinding mechanism shown in FIG. 1.

The paper feeding device shown in FIG. 1 further includes a paster arm 25 arranged between the frames F1 and F2 to act upon the paper connection work. The paster arm 25 is provided with a brush 26 to bring the travelling paper web P into contact with the circumferential surface of the succeeding paper roll, and a cutter 27 for cutting the paper web P at upstream from the connected line. As shown in FIG. 4, the paper end Q of the second paper roll R2 is previously provided with a sticky or adhesive member.

Next, a typical operation of the above described embodiment is described as follows.

Figure 5:
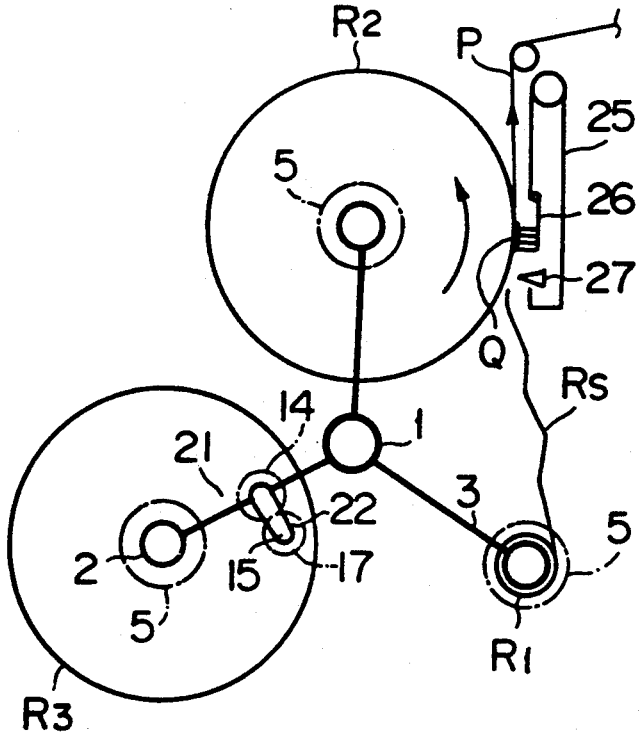

In FIG. 4, when a sensor, not shown, detects that the diameter of the first paper roll R1 is smaller than a first predetermined diameter, the second paper roll R2 is rotated in the counter-clockwise direction and is accelerated so that the circumferential speed of the second paper roll R2 is the same as the travelling speed of the paper web P. Then, the paster arm 25 is moved from the waiting position shown in FIG. 4, to the working position shown in FIG. 5. When the sensor detects that the diameter of the first paper roll R1 is smaller than a second predetermined diameter, the brush 26 forces the travelling paper web P to be brought into contact with the circumferential surface of the second paper roll R2.

The paper end Q of the second paper roll R2 is adhered to the travelling paper web P and such that they travel together. At substantially the same time, the cutter 27 is brought into contact at an upstream location of the travelling paper web P such that it is cut. After this, the paper web P1 from the second paper roll R2 is moved through the printing apparatus instead of the paper web P.

Figure 6:
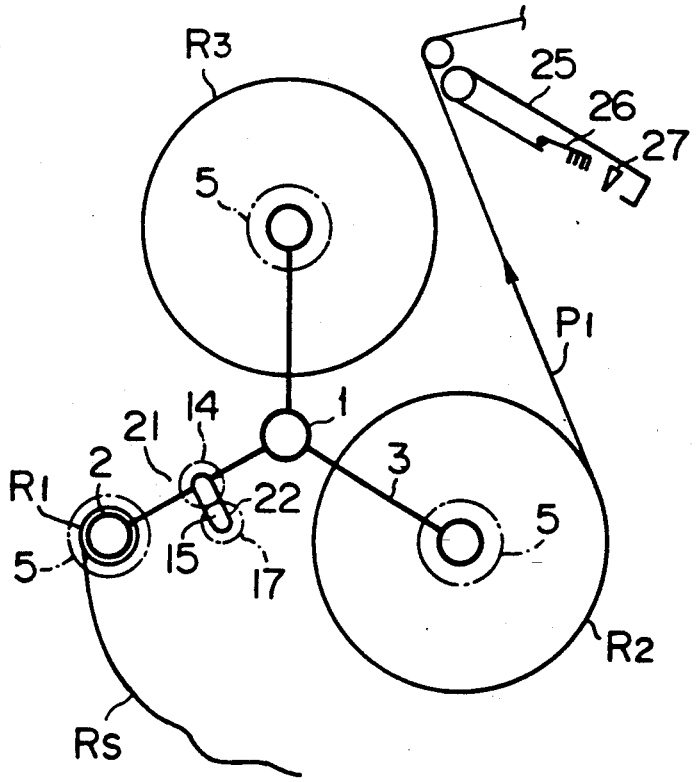

On the other hand, the rotation of the first paper roll R1 is stopped by a stopper, not shown, arranged at the support stem 4. The cut paper web RS is released and drops down. The paster arm 25 is returned to its waiting position as shown in FIG. 6. The rotary shaft 1 is rotated clockwise by the energized motor M1, and thus the Y-form support members 2, 2 are also turned so that the paper rolls R1, R2 and R3 are moved toward the positions shown in FIG. 6.

When another sensor, not shown, detects that the gear 5 secured to the support stem 4 of the paper roll R1 arrives at the predetermined position where the gear 5 can be engaged with the gear 17 of the drive power transmission unit B, the sensor outputs a stop signal to the first motor Ml. The Y-form support members 2, 2 are also stopped. Under this condition, the arm 15 of the drive power transmission unit B is in contact with the stopper 22, and the support stem 4 for the paper roller R1 is already released from its break mechanism, not shown. The second motor M2 is rotated in the clockwise direction after the Y-form support members 2, 2 are stopped. Since the gear 17 is always subjected to an urging force by the dish-shape spring 19 and the spring shoe 20 to prevent it from rotating due to a predetermined low torque level, the gear 17 is not rotated about the shaft 16 by the turning force of the second motor M2. The gear 14, the arm 15 and the gear 17 are rotated clockwise about the shaft of the second motor M2 as a single unit until the arm 15 conflicts with the stopper 21. When the arm 15 is in contact with the stopper 21, the gear 17 is engaged with the gear 5 of the support stem 4.

Figure 7:
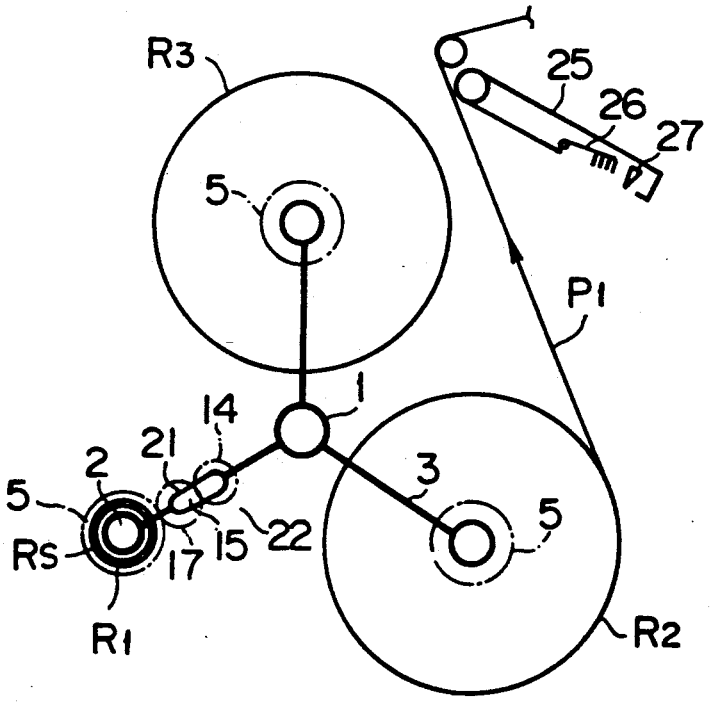

When the rotatory movement of the arm is restricted by the stopper 21, the turning force of the second motor M2 is transmitted to the gear 17 through the gear 14. Since this turning force is greater than the urging force of the dish-shape spring 19, the gear 17 can be turned about the shaft 16 so that the turning force of the gear 14 is transmitted to the gear 5 of the support stem 4. According to this power transmission, the paper roll R1 supported by the support stem 4 is turned in the clockwise direction to rewind the remaining paper RS as shown in FIG. 7. The second motor M2 stops after the rewinding operation.

Then, the second motor M2 turns counter-clockwise. This counterclockwise turning force moves the arm 15 from the retaining position at stopper 21. Thus the gear 14, the arm 15 and the gear 17 are combined again as a single unit due to the urging force of the dish-shape spring 19, and they are turned counter-clockwise until the arm 17 contacts stopper 22. The gear 17 is then released from the gear 5.

The sensor, not shown, detects when the arm 15 conflicts with the stopper 22, and outputs a stop signal to the second motor M2. The motor M2 stops its turning motion and remains in a waiting state.

The detected signals from the sensors are processed by any control devices which are well known.

It is further understood by those skilled in the art that the foregoing description is a preferred embodiment of the disclosed device and that various changes and modifications may be made in the invention without departing from the spirit and scope thereof. For example, friction wheels may be substituted for the gears 5, 14 and 17; the friction plate 18, the dish-shape spring 19 and the spring shoe 20 used for retaining the gear 17 on the shaft 16 may be replaced with Torque Keeper or Slipping Clutch, trade name.

As disclosed above, the inventive remaining paper rewinding device is simply constructed to reduce its manufacturing cost and size. Further this simple device provides for a highly maintainable apparatus which can be easily assembled.

What is claimed is:

1. A method for rewinding paper on a paper roll, comprising the steps of:

(a) mounting said paper roll on first and second support stems which are rotatably mounted in respective first and second rotatable support members, said first support stem having a drive unit attached thereto;

(b) rotating said first and second support members into a first position where paper is unwound from said paper roll;

(c) rotating said first and second support members into a second position which is proximate to a drive power transmission;

(d) rotating said drive power transmission into engagement with said drive unit;

(e) driving said drive power transmission whereby paper on said paper roll is rewound due to the engagement of said drive power transmission and said drive unit.

2. An apparatus for rewinding paper comprising:

a frame;

a first shaft being rotatably supported in said frame;

first and second paper roll support members mounted opposite to each other on said shaft and being rotatable therewith;

a first plurality of paper support stems which are each rotatably disposed on said first support member;

a second plurality of paper support stems which are each rotatably disposed on said second support member, each of said second plurality of paper support stems being aligned along a common rotational axis with a corresponding one of said second plurality of paper support stems such that each pair of aligned support stems supports a paper roll;

a plurality of drive units each being connected to a respective one of said first plurality of paper support stems;

a first power unit;

a drive power transmission unit being operatively connected to said first power unit and being selectively engageable with each of said drive units thereby transmitting a rotating drive force to said selected drive unit so that said respective one of said first plurality of paper support stems associated with said selected drive unit is forced to rotate causing a rewinding of said paper roll.

3. An apparatus as recited in claim 2, wherein said drive power transmission is rotatable between first and second positions by said first power unit such that when said drive power transmission is in said first position said drive power transmission engages with said selected drive unit and when said power transmission is in said second position said drive power transmission does not engage with said selected drive unit.

4. An apparatus as recited in claim 3, further comprising a second power unit which is operatively connected to said first shaft and which rotates said first shaft when energized.

5. An apparatus as recited in claim 4, wherein when said second power unit is energized said first and second support members are rotated so that said selected drive unit rotates to a point proximate to said drive power transmission such that when said drive power transmission is rotated into said first position it engages with said selected drive unit.

6. An apparatus as recited in claim 5, wherein said drive power transmission includes a first gear, an arm, a second gear and a second shaft, said arm is rotatably mounted on said first gear and is mounted on said second shaft, said second gear is mounted on said second shaft and engages with said first gear and said selected drive unit.

7. An apparatus as recited in claim 6, wherein said drive power transmission further comprises a friction plate, a spring, and a spring shoe which are each mounted on said second shaft, and said spring is disposed between said spring shoe and said friction plate such that a biasing force produced by said spring acts on and forces said friction plate against said second gear so that said second gear is retained between said friction plate and said sleeve.

* * * * *